United States Patent [19]

Imria

[11] Patent Number: 5,053,933

[45] Date of Patent: Oct. 1, 1991

[54] FLUORESCENT LAMP

[76] Inventor: Pavel Imris, Hohes Feld 17, D-3162, Uetze 5, Fed. Rep. of Germany

[21] Appl. No.: 507,157

[22] Filed: Apr. 10, 1990

[30] Foreign Application Priority Data

Apr. 17, 1989 [DE] Fed. Rep. of Germany ..... 3912514

[51] Int. Cl.[5] ..... F21V 23/02

[52] U.S. Cl. ..... 362/221; 362/260; 315/209 R

[58] Field of Search ..... 362/217, 221, 260, 265; 315/209 R, 224, 244

[56] References Cited

U.S. PATENT DOCUMENTS

| | | | |
|---|---|---|---|
| 2,001,501 | 5/1946 | Ruttenauer et al. . | |
| 3,609,436 | 9/1971 | Campbell . | |
| 4,636,691 | 1/1987 | de Man et al. | 315/209 r |

FOREIGN PATENT DOCUMENTS

| | | |
|---|---|---|
| 1199882 | 9/1965 | Fed. Rep. of Germany . |
| 2835574 | 3/1979 | Fed. Rep. of Germany . |
| 2725412 | 5/1985 | Fed. Rep. of Germany . |
| 518204 | 2/1940 | United Kingdom . |

OTHER PUBLICATIONS

Technische-Wissenschaftliche Abhandlungen der Osram-Gesellschaft, 1986, vol. 12, pp. 383-393.

*Primary Examiner*—Stephen F. Husar
*Attorney, Agent, or Firm*—Collard, Roe & Galgano

[57] ABSTRACT

The fluorescent lamp consists of a discharge space outwardly limited by a glass tube and of discharge electrodes as well as of an elongated inner element that limits inwardly the discharge space. The entire inner wall of the glass tube and the outer wall of the inner element are covered with a layer of fluorescent material and inside of the inner element, at least along a part of its entire length, an electrically conductive material is placed that is connected with a discharge electrode. In order to improve the lamp efficiency and also to reduce the cost of manufacture of such a lamp, the lamp according to the invention is so designed that the inner element is a support for the capacitor elements which are placed in the inner space of the inner element. The capacitor elements extend at least along a part of the entire length of the inner element. An electrical potential emitting from the said capacitor elements acts perpendicular against the known discharge current of the lamp. The said capacitor elements are connected through wires with a high frequency generator and other electronic ballast whereby the inner space of the inner element is open to atmospheric pressure, however, this inner space of the inner element is sealed gas-proof against the discharge space of the lamp.

9 Claims, 3 Drawing Sheets

3

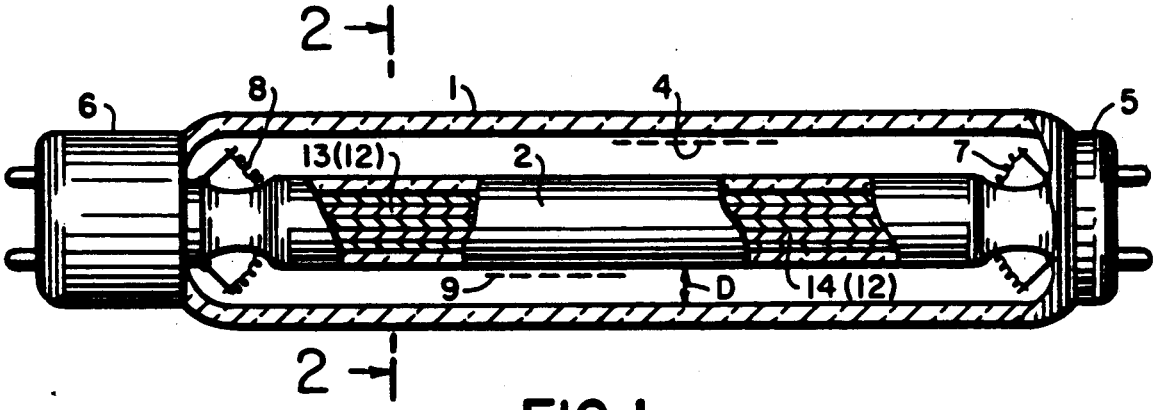
FIG.1
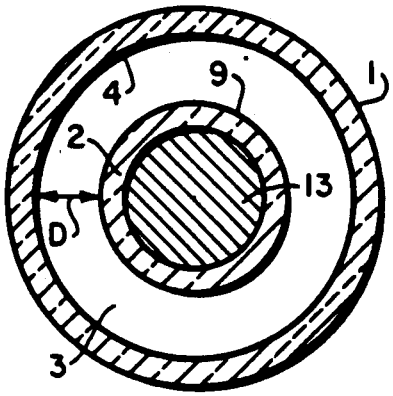
FIG.2
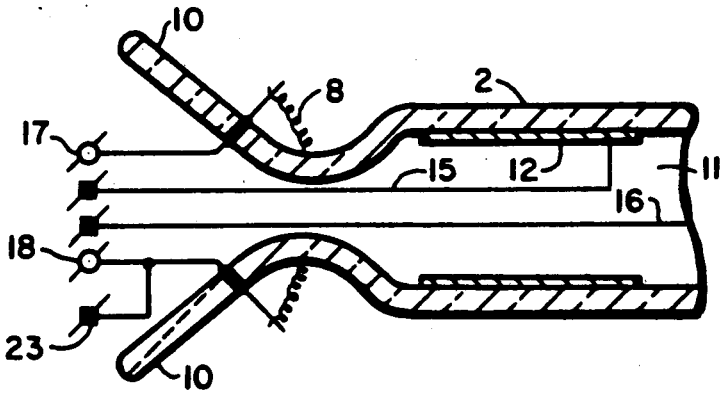
FIG.

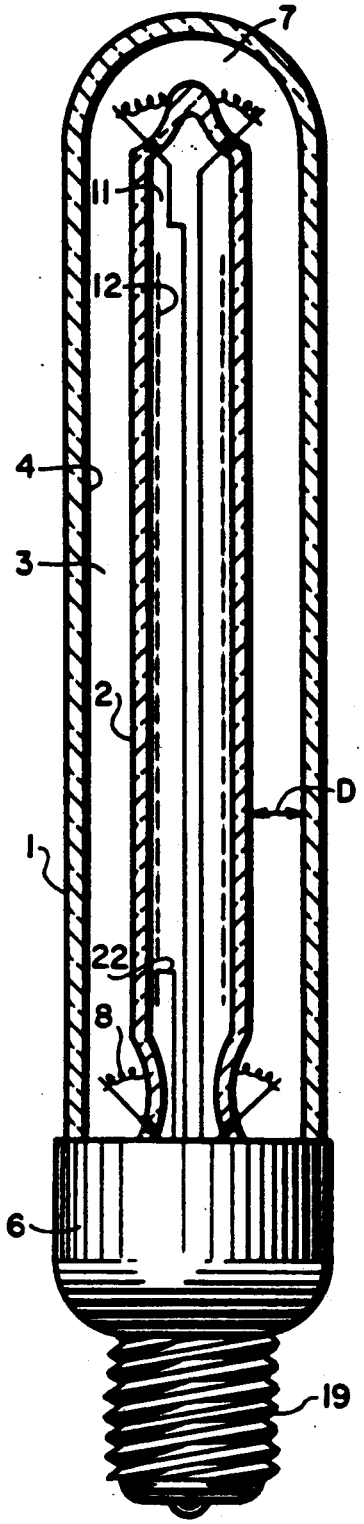
FIG.4
FIG.5
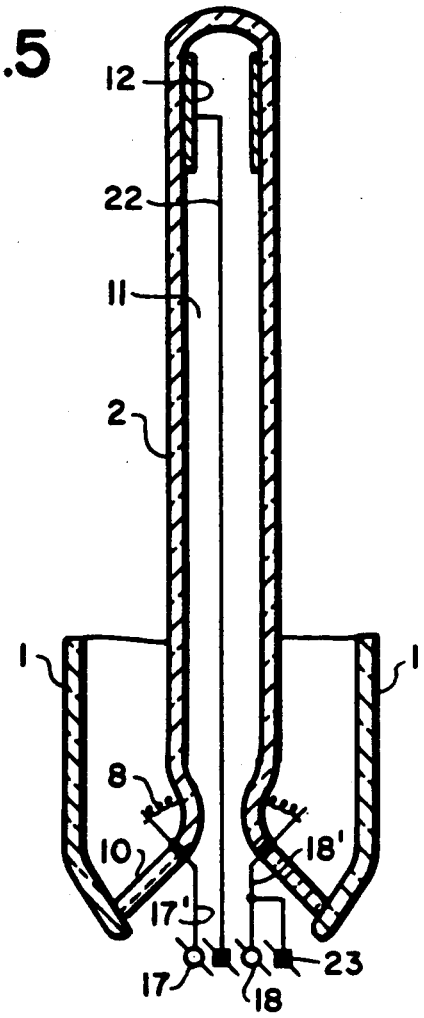
FIG.6
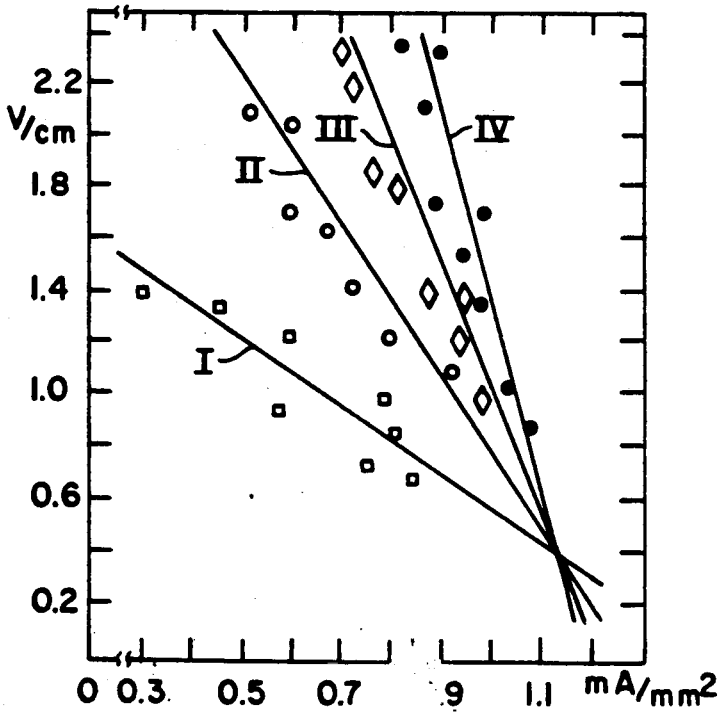

FLUORESCENT LAMP

BACKGROUND OF THE INVENTION

The invention relates to fluorescent lamps which a potential is applied to the electrodes and between the two electrodes a gas discharge takes place in a closed space.

Such fluorescent lamps are known from the German Patent No. 11 99 882. According to the German Patent No. 27 25 412 and to the U.S. Pat. No. 36 09 436 as well as according to the U.S. Pat. No. 20 01 501, the British Patent No. 518 204 and the German Patent No. 28 35 574 it is further known to place in the inner space of fluorescent lamps straight or U-shaped discharge tubes and to provide them with several discharge electrodes. According to the German Patent No. 27 25 412 it is furthermore known, that the outer wall of the discharge tube is over half of its circumference and along its entire length provided with a layer of fluorescent material. The lamps according to these patents are small, they have an Edison base and the discharge takes place in the inner discharge tube and in the outer glass tube, respectively. The electrical discharge in the discharge space produces an ultraviolet radiation that is being converted in the layer of fluorescent material into visible light. The said UV-radiation produced in the inner discharge tube participates, however, merely to a small extent in the production of visible light that is radiated from the surface of the glass tube into the environment. For this reason, the light output or the lamp efficiency of such lamps is relatively low. The electrical energy necessary for the discharge in the inner discharge tube amounts to approx. 50% of the total energy input and, as a result, merely 10% of this energy participates in the total light output of this lamp. A further disadvantage of the heretofore known lamps is the difficult attainable homogeneity of the light distribution on the surface of the lamp. A still further economic disadvantage is the plurality of discharge electrodes required by this type of lamp. Moreover, the control of such a plurality of electrodes requires a complicated and expensive electrical circuitry.

To the state of the prior art belong also lamps that are known in literature as "compact lamps". From the Osram publication, Technische-Wissenschaftliche Abhandlungen der Osram-Gesellschaft, 1986, volume 12, pp. 383 to 393, it is known that these compact lamps are provided with electronic ballast and with an Edison base and are being operated with a higher frequency of discharge current. The advantages of the compact lamp in comparison with the smaller lamps described in the patents quoted above are the smaller dimensions, the improved lamp efficiency and the negligible light flicker. While they have the mentioned advantages, these compact lamps are very expensive and the lamp efficiency is still relatively low.

In regard to the fluorescent lamp described in the German Patent No. 11 99 882, an inner element, placed in the discharge space of the lamp, is an electrically conductive construction part and serves mainly as an auxiliary starter electrode. At the same time, this construction part enlarges the so-called recombination surface of the discharge space.

OBJECT OF THE INVENTION

The object of the invention is firstly to further improve the efficiency of fluorescent lamps and secondly, to be able to reduce further the cost of manufacture of fluorescent lamps.

SUMMARY OF THE INVENTION

The fluorescent lamp of the present invention a discharge space outwardly limited by a glass tube containing discharge electrodes as well as an elongated inner element that limits inwardly the discharge space, the entire inner wall of the glass tube and the outer wall of the inner element being covered with a layer of fluorescent material. Inside of the inner element, at least along a part of its entire length, an electrically conductive material is placed and the said electrically conductive material is electrically connected with a discharge electrode.

In order to achieve the object, the inventor has found that such a fluorescent lamp has to be constructed in such a manner that the inner element is the support for capacitor elements which are placed along the entire length of the inner space of the inner element or along a part of its entire length. An electric potential emitting from the said capacitor elements acts perpendicularly against the known discharge current of the lamp. The said capacitor elements are connected through wires with a high frequency generator and other electronic ballast, and furthermore the inner space of the inner element is open to atmospheric pressure, and is sealed gas-impermeable against the discharge space of the lamp.

Further advantageous embodiments of the invention consist of the following:

On both ends of the outer wall of the inner element, near the conically shaped ends, discharge electrodes are placed gas-impermeable and which are connected through wires to a supply voltage and electronic ballast.

On one end of the outer wall of the inner element, near the conically shaped end, a discharge electrode is placed gas-impermeable and on the other end of the inner wall of the inner element a capacitor element is provided and connected through a wire with a high frequency generator.

The inner space of the inner element is at least along a part of its entire length filled with electrically conductive material, such as aluminum wool, fine metal chips or metal powder, this material being connected through a wire with a high frequency generator and electronic ballast.

On the inner wall of the inner element a lattice is arranged at least along a part of its entire length and is connected through a wire with a high frequency generator and electronic ballast.

The electrical wires are arranged in the inner space of the inner element.

The fluorescent lamp according to the invention operates in comparison to all known fluorescent lamps with two electric fields, and this is essential to the invention, the first electric field extending in a known manner between two discharge electrodes in the discharge space and the second electric field extending from the inner space of the inner element perpendicularly against the said first electric field.

ADVANTAGES OF THE INVENTION

The economic advantage of the fluorescent lamp according to the present invention is the substantially higher light output per unit of the supplied electrical energy in comparison with the lamp efficiency of known fluorescent lamps. The achievable efficiency of the fluorescent lamp according to the present invention is nearly twice as high as the efficiency of known fluorescent lamps which are being operated with 50 Hz. Furthermore, according to the present invention the efficiency of the lamp is approximately 1.6 times higher than the efficiency of the known so-called "compact lamps" which operate with 35 kHz. A further advantage is the homogeneous luminous flux which occurs on the surface of the glass tube of the lamp and, furthermore, the ballast necessary for both electric fields can be more easily manufactured and is much less inexpensive than the ballast of known fluorescent lamps with comparable light output apart from the fact, that the total cost of manufacture of the fluorescent lamp according to the present invention is substantially reduced in comparison with that of known lamps.

BRIEF DESCRIPTION OF THE DRAWINGS

In order that the present invention may be more readily understood, reference will now be made to the accompanying drawings, in which:

FIG. 1 is partially a sectional and side elevational view of the fluorescent lamp of the present invention in tubular shape.

FIG. 2 is an enlarged cross-sectional view of the lamp along line 11—11 in FIG. 1.

FIG. 3 is a sectional view of one end of the inner element of the fluorescent lamp shown in FIG. 1.

FIG. 4 is partially a sectional and side elevational view of the fluorescent lamp in cylindrical shape.

FIG. 5 is a sectional view of a special embodiment of the inner element.

FIG. 6 is a graphic illustration of the potential gradient dependent upon the discharge current density.

DETAILED DESCRIPTION OF THE PREFERRED EMBODIMENTS

Figure 7:
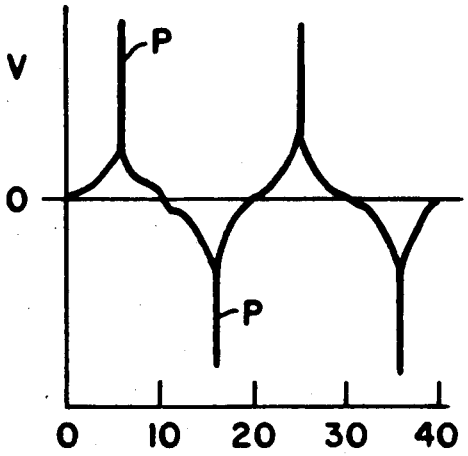
FIG. 7 is a graphic illustration of the pulse potential on the condenser plate dependent upon time.

The fluorescent lamp shown in FIGS. 1, and 3 consists of a glass tube 1 and of a discharge space 3 limited by glass tube 1 and by the inner element 2. The inner wall of the glass tube 1 is covered with a fluorescent material 4. The discharge space 3 contains mercury-vapor as well as a noble gas or a noble gas mixture. In the region of both inner ends of glass tube 1 discharge electrodes 7 and 8 are arranged on the inner element 2 in discharge space 3 as is shown in FIG. 1. The electrical discharge takes place between electrodes 7 and 8 in the discharge space 3. The outer surface area of the inner element 2 is covered also in its entire length with a fluorescent material 9 or alternatively with a UV-reflector. The inner element 2 is arranged concentrically about the longitudinal axis of the lamp tube 1 and its conically projecting ends 10 are connected in a gas-impervious manner to the inner ends of the lamp tube 1, ends 10 of the inner element 2 and lamp tube 1 being bound on one end of lamp tube 1 in cap 5 and on the other end in base 6. The inner element 2 consists of a glass tube as does lamp tube 1.

Figure 9:
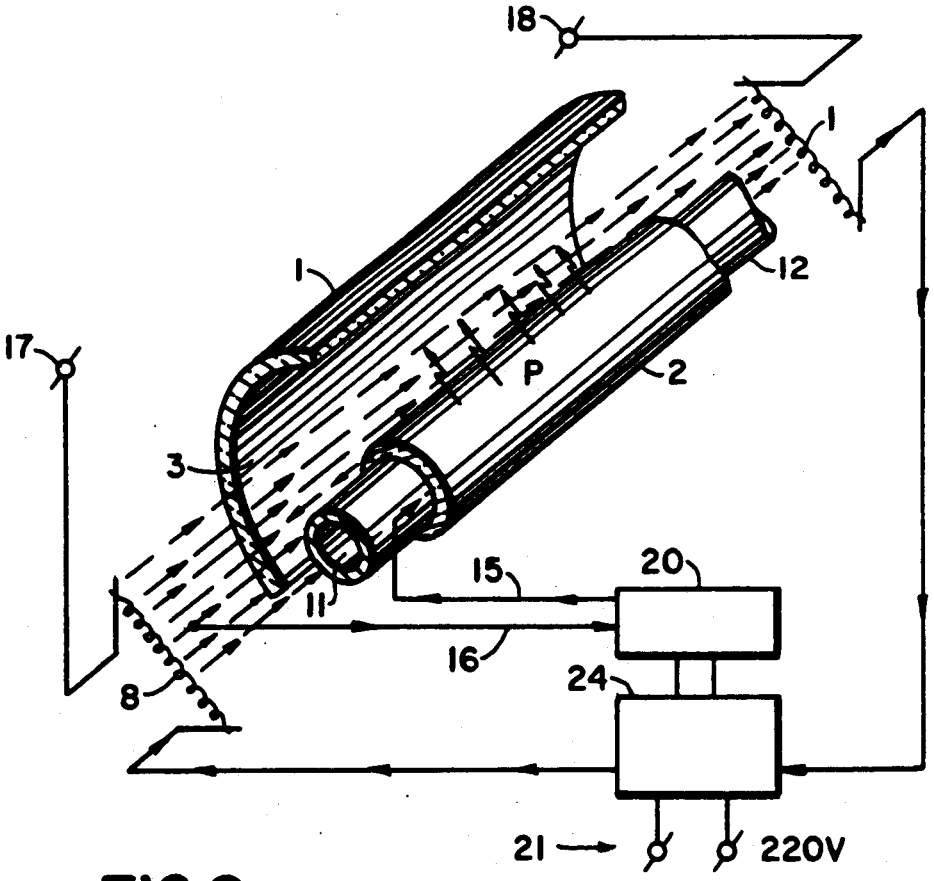
FIG. 9 represents the functional principle of the present invention.

According to FIG. 3 electrode 8 is mounted in a gas-impervious manner in to the conically projecting ends 10 of the inner element 2 and electrically connected through wires 17, 18 with the supply voltage, the ballast being interpositioned between the supply voltage and electrode 8 (FIG. 9). Electrode 7 is mounted in the same manner on the other end of inner element 2 and further connected with base 5. In the inner space 11 of the inner element 2 one or several capacitor elements 12, such as metal plates, are arranged which are electrically connected through wires 15 and 16, respectively, with a high frequency generator 20 incorporated in the elongated base 6 (see FIG. 9). The capacitor elements 12 (FIG. 3) may consists of a sheet metal, a screen, a metal layer or the like. The capacitor elements may also consist of fine metal chips or of "aluminum wool" 13 or of a metal lattice 14 with which the inner space of the inner element is simply filled. These parts are capacitor elements because during the operation of the lamp the said parts are in an electrically charged state. The plasma electrically conducting in the discharge space 3 represents the second electrical conductor of the electrical capacitor and the glass wall of the inner element 2 represents the dielectric of the said capacitor. In such a capacitor oscillates an electric field that originates from the voltage supply incorporated in base 6. Through wires 17 and 18 flows an electric current to electrode 8 and said electric current is simultaneously the discharge current which flows between electrodes 7 and 8.

Base 5 and 6 are designed in such a manner that they fit into known sockets. The length of the lamp according to FIG. 1 can, as occasion demands, be between 450 mm and 2370 mm and the diameter of the glass tube 1 can be between 30 and 55 mm. The distance D between the inner wall of the inner element 2 can be, for example, between 5 to 13 mm.

Referring now to FIGS. 4 and 5, there is shown a so-called compact lamp equipped with electronic ballast (high frequency generator 20/filter choke 24) incorporated into the base 6 and further provided with an Edison base 19 that may be inserted immediately into existing fixtures for incandescent lamps. The capacitor element 12 extends along the entire length of the inner space 11 of the inner element 2 and is advantageously made of a metal screen which is simply inserted into the glass tube in the manufacture of the inner element 2. The electrical wire 22 connects the metal screen 12 with the high frequency generator located in base 6, but which is not specifically shown in FIG. 4.

FIG. 5 illustrates another embodiment of the inner element 2, in which, merely discharge electrode 8 is provided at conically shaped end 10 and a short capacitor element 12 is arranged at the other end of the inner space 11, said capacitor element 12 being connected through wire 22 with the voltage supply 21 located in base 6. The second pole of the voltage supply is connected through wire 23 with electrode 8 and the electric circuit between capacitor element 12 and the plasma in the discharge space 3 is closed through the glass wall of the inner element 2. The length of the lamp may be, for example, 150 mm up to 250 mm and the outer diameter of glass cylinder 1 can be 30 mm to 60 mm. The inner space 11 of the inner element 2 is not hermetically sealed against atmospheric pressure which applies also to the inner space of the inner element 2 of the lamp shown in FIG. 1. The whole wiring of the lamp according to FIGS. 1 to 5 is located in the inner space 11 of the inner element 2.

Depending on the required light output and according to the geometrical and electrotechnical parameters of the lamp, it has to be decided, whether merely one capacitor element 12 (FIG. 5) or two separate capacitor elements 12 (FIG. 3) are to be used for the construction of the lamp. This decision depends upon the operating frequency of the electric potential applied to the capacitor elements 12, 13 or 14, respectively, as well as upon which distance D the inner element 2 has from the glass tube 1. If the distance D is relatively small, then the frequency of the oscillating electric potential on the capacitor elements has to be higher than with a relatively greater distance D. The lamp efficiency according to the invention is conversely proportional to the distance D between the inner element 2 and glass tube 1, i.e., with a smaller distance D the lamp efficiency increases and vice versa. A second parameter which improves the lamp efficiency, is the frequency of the oscillating potential applied to the capacitor element 12. A third important parameter for the improvement of the lamp efficiency is the pulse duration of one so-called monopolar electric pulse which is applied to the said capacitor elements. If the duration of the pulse is shorter, specifically, if the time for the rising portion of the pulse is shorter, then the efficiency of the fluorescent lamp is higher.

The lamp shown in FIG. 1 is connected in a known manner to the usual supply voltage of 50 Hz. After starting the lamp, the discharge current flows between electrodes 7 and 8 and simultaneously, the electric potential of the capacitor element 12 acts through the wall of the inner element 2 perpendicularly on the discharge current (see FIG. 9). This perpendicularly acting electric potential increases the electrical resistance of the plasma located in the discharge space 3. The electrical resistance of the plasma increases proportionally with this perpendicularly acting electric potential. This effect takes place mainly, when the current density of the discharge current in the plasma is greater. This physical phenomenon controls the homogeneity of the electric current in the entire discharge channel 3. If, for example, the current density in a locally limited small space rises faster than in an adjacent space, then, under the influence of the perpendicular electric potential, the electrical resistance in the space with fast rising current density rises faster, whereby the further current density ($mA/mm^2$) rise is slowed down. In the end effect, by this phenomenon, a homogeneous current density is achieved in the entire discharge channel 3. A homogeneous current density in the discharge channel 3 guarantees a homogeneous light distribution of visible light on the surface of glass tube 1.

According to FIG. 6 and as mentioned above, the electrical resistance of the plasma in the discharge space 3 is furthermore dependent upon the distance D. if distance D between the inner wall of the glass tube 1 and the outer wall of the inner element 2 becomes smaller, the resistance of the plasma increases. The resistance of the plasma per centimeter of the discharge length can be easily calculated from the data in FIG. 6. The potential in volt per centimeter (V/cm) of the length of the lamp, also called potential gradient, is given on the vertical axis in FIG. 6 and the current density ($mA/mm^2$) of the discharge current is stated on the horizontal axis. All data in FIG. 6 were measured without the perpendicular potential. Each curve in FIG. 6 shows the dependence of the potential gradient upon the current density by a different distance D. For curve I, the distance D=13 mm, for curve II is D=10 mm, for curve III is D=8 mm and for curve IV is the distance D=5 mm.

A lamp with a distance D=5 mm has the relative highest potential gradient whereas a lamp with a distance D=13 mm has the smaller potential gradient. The data in FIG. 6 changes considerably, if a pulsating potential with a short duration is applied to the capacitor elements. It is advantageous if the perpendicular potential consists of pulses with short duration and if the pulse frequency is high. All known high frequency generators are usuable for the production of such perpendicular potential, such high frequency generators being most suitable that produce pulses with a rise time in the range of nanoseconds ($1 \cdot 10^{-9}$ sec.) Thus a small high frequency pulse generator according to the German Offenlegungsschrift No. 37 06 385 has been incorporated in the base 6. The frequency of the monopolar pulses produced by this H.F. pulse generator is adjustable in a broad spectrum. The polarity of the pulses P is the same as the polarity of the half period of the carrier current.

FIG. 7 shows schematically the curve of an oscilloscope. There is one monopolar pulse P in each half period of the supply voltage of 50 Hz. The pulse potential (V) is on the vertical axis and the time in milliseconds (ms) is given on the horizontal axis. These pulses p are transmitted to the capacitor elements 12.

Figure 8:
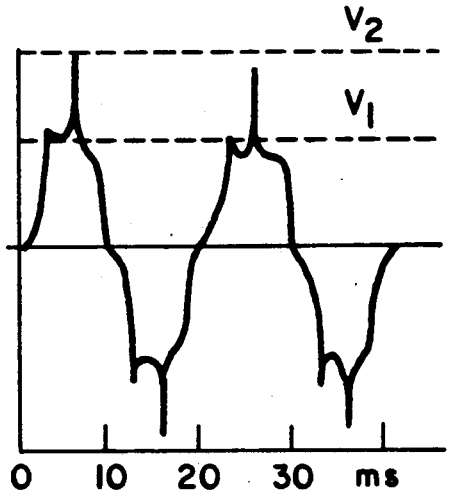
FIG. 8 is a graphic illustration of the discharge potential dependent upon time.

FIG. 8 shows schematically another graphic illustration of the oscillation of the discharge current in the discharge space 3. The discharge current oscillates between the electric potential $V_1$ and $V_2$ under the influence of pulse P and simultaneously with pulse p. A higher frequency of the pulses P than the frequency depicted in FIG. 7 produces naturally a higher oscillation of the discharge current in discharge channel 3. The oscillating perpendicular potential P on the capacitor elements produces an oscillation of the plasma in the discharge channel 3. This oscillation of the plasma is also dependent upon the frequency of the discharge current that flows between electrodes 7 and 8. Every known high frequency generator 20 which will be connected to the said capacitor elements produces an oscillation of the plasma in discharge channel 3 and improves, therewith, substantially the efficiency of such lamps.

The attached table 1 shows the light output in lumen per Watt (lm/W) for lamps with a distance D of 5 mm and D=8 mm and with different electrical energy input at 50 Hz through electrodes 7 and 8 into the discharge channel and, furthermore, the energy input of approximately 35 kHz through the capacitor elements. According to column 2 of table 1, the electrical energy input at 50 Hz is 88% and the electrical energy input at 35 kHz is 12%. The lamp efficiency for the lamp shown in FIG. 1 with a distance D=5 mm is 157 lm/W and at a distance D=8 mm the lamp efficiency is 128 lm/W. The data in columns 3 and 4 indicate the efficiency of the lamp at other ratios of the energy input.

The example given in column 1 clearly shows the light output of a lamp without a high frequency generator, in which merely a pulse frequency of 50 Hz was applied to the capacitor elements 12. With such a simple electric circuitry, the light output of the lamp, shown in FIG. 1, is 93 lumen per Watt.

The data given in table 1 distinctly show that one saves on expensive high frequency generators because the electrical energy input of the high frequency has only an insignificant share in the total electrical energy input. For example, with a lamp with a total light output of 4,600 lumen 30 Watts total electrical energy is needed whereof only 8 Watts are at 35 kHz and 22 Watts are at 50 Hz.

The lamp efficiency of the compact lamp according to FIG. 4 is approximately 1.6 times higher than the lamp efficiency of known compact lamps of this type. For the compact lamp, according to FIG. 4, a high frequency generator 20 is usuable that generates a frequency of approximately 35 kHz. A still higher efficiency can be achieved, if the compact lamp, shown in FIG. 4, will be operated with a small high frequency pulse generator built after the principle described in the German Offenlegungsschrift No. 37 06 385. The cost of manufacture of the compact lamp in FIG. 4 is considerably lower than the production cost of the known compact lamp with a comparable light output.

TABLE 1

| | 1 | | 2 | | 3 | | 4 | |
|---|---|---|---|---|---|---|---|---|
| | Lamp Operating Frequencies | | | | | | | |
| | 50 Hz | 50 Hz | 50 Hz | 35 kHz | 50 Hz | 35 kHz | 50 Hz | 35 kHz |
| | Lamp Operating Power | | | | | | | |
| | 99% | 1% | 88% | 12% | 75% | 25% | 60% | 40% |
| D = 5 mm | 93 lm/W | | 157 lm/W | | 170 lm/W | | — | |
| D = 8 mm | 72 lm/W | | 128 lm/W | | 153 lm/W | | 160 lm/W | |

What I claim is:

1. A fluorescent lamp comprising (a) an outer glass tube having an inner wall, (b) an elongated inner element defining an elongated inner space and having an outer wall, (1) the inner glass tube wall and the outer wall of the inner element defining a discharge space therebetween, (c) a layer of a fluorescent material covering the walls, (d) capacitor means supported by the inner element in the inner space along at least a part of the length of the inner space, (1) the capacitor means being arranged to generate an electric field extending perpendicularly to the discharge space, (e) a high frequency generator and electronic ballast, and (f) electrical conductor means connecting the high frequency generator and electronic ballast to the capacitor means, (1) the inner space being in communication with the ambient atmosphere and being gas-impervious ously sealed against the discharge space.

2. The fluorescent lamp of claim 1, wherein the inner element has opposite conically shaped ends, and further comprising discharge electrodes arranged on the outer wall of the inner element near the conically shaped ends and being arranged in a gas-impervious manner on the inner element, a source of voltage, electronic ballast, and electrical conductor means connecting the electrodes to the voltage source and electronic ballast.

3. The fluorescent lamp of claim 1, wherein the inner element has a conically shaped end, and further comprising a discharge electrode arranged on the outer wall of the inner element near the conically shaped end and being arranged in a gas-impervious manner on the inner element, the capacitor means comprising a capacitor element arranged on the inner wall of the inner element at an end opposite to the conically shaped end, a high frequency generator, and electrical conductor means connecting the capacitor element to the high frequency generator.

4. The fluorescent lamp of claim 1, wherein the capacitor means comprises an electrically conductive particulate material filling the inner space along at least a part of the length of the inner space.

5. The fluorescent lamp of claim 4, wherein the particulate material is aluminum wool.

6. The fluorescent lamp of claim 4, wherein the particulate material is comprised of fine metal chips.

7. The fluorescent lamp of claim 4, wherein the particulate material is comprised of metal powder.

8. The fluorescent lamp of claim 1, wherein the capacitor means comprises an electrically conductive lattice extending along at least a part of the length of the inner wall of the inner element.

9. The fluorescent lamp of claim 1, wherein the electrical conductor means are arranged in the inner space of the inner element.

* * * * *